US007089897B2

(12) United States Patent
Schäfer et al.

(10) Patent No.: US 7,089,897 B2
(45) Date of Patent: Aug. 15, 2006

(54) ELECTRICALLY DRIVEN CAMSHAFT ADJUSTER

(75) Inventors: Jens Schäfer, Herzogenaurach (DE); Martin Steigerwald, Erlangen (DE); Jonathan Heywood, Pettstadt (DE)

(73) Assignee: INA-Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/018,449

(22) Filed: Dec. 20, 2004

(65) Prior Publication Data

US 2005/0103299 A1 May 19, 2005

Related U.S. Application Data

(63) Continuation of application No. PCT/EP03/06957, filed on Jul. 1, 2003.

(30) Foreign Application Priority Data

Jul. 11, 2002 (DE) ..... 102 31 226

(51) Int. Cl.
*F01L 1/34* (2006.01)

(52) U.S. Cl. ..... 123/90.17; 123/90.11; 123/90.31

(58) Field of Classification Search ..... 123/90.15, 123/90.16, 90.17, 90.18, 90.27, 90.31, 90.11; 251/129.01, 129.15
See application file for complete search history.

(56) References Cited

U.S. PATENT DOCUMENTS 3,809,979 A * 5/1974 Zarth ..... 318/762
4,945,269 A * 7/1990 Kamm ..... 310/15
4,986,801 A * 1/1991 Ohlendorf et al. ..... 475/331
5,673,659 A * 10/1997 Regueiro ..... 123/90.17
5,680,837 A * 10/1997 Pierik ..... 123/90.17
6,216,654 B1 * 4/2001 Regueiro ..... 123/90.15
6,257,186 B1 7/2001 Heer
6,457,446 B1 * 10/2002 Willmot ..... 123/90.17
2002/0053327 A1 5/2002 Schäfer et al.

FOREIGN PATENT DOCUMENTS

DE 36 38 527 5/1988
DE 41 10 195 10/1992
DE 199 10 210 9/2000

* cited by examiner

*Primary Examiner*—Thomas Denion
*Assistant Examiner*—Ching Chang
(74) *Attorney, Agent, or Firm*—Volpe and Koenig, P.C.

(57) ABSTRACT

An electrical adjusting device for changing an angle of rotation of a camshaft (3) relative to a crankshaft of an internal-combustion engine is provided. The device includes an adjusting gear unit (1), which is formed as a triple-shaft gear unit, including an input part (4) that is fixed to the crankshaft, an output part (5) that is fixed to the camshaft, and an adjusting shaft (6), which is connected in a torsion-proof manner to an electric adjusting motor (2) having a permanent magnet rotor and a stator (8) fixed to the housing. A stationary gear ratio ($i_0$), the value of which defines the adjusting gear unit (1) as a positive or negative gear unit and deter-mines whether a direction of adjustment of the cam-shaft (3, 65, 69) is into an advanced or retarded base position, is located between the input part (4) and the output part (5) when the adjusting shaft is at rest. Due to the configuration of the adjusting gear unit (1), stationary gear ratios are provided, through which an advanced and a retarded base position of the camshaft (3, 65, 69) can be reached exclusively through braking of the adjusting shaft (6) when the adjusting gear unit (1) is rotating, and the braking of the adjusting shaft (6) is carried out through short-circuit braking of the adjusting motor (2).

15 Claims, 3 Drawing Sheets

ELECTRICALLY DRIVEN CAMSHAFT ADJUSTER

BACKGROUND

The invention relates to an adjusting device for changing the angle of rotation of a camshaft relative to the crankshaft of an internal-combustion engine.

To guarantee reliable engine startup in an internal-combustion engine with a hydraulic or electric camshaft adjuster, the camshaft must be located in a certain base position relative to the crankshaft during startup. Typically, for an inlet camshaft, it is a "retarded" position, and for an exhaust camshaft, it is an "advanced" position.

In normal vehicle operation, the camshaft is moved in a controlled way into the appropriate base position when the engine is turned off and the camshaft is fixed or locked in this position. For this purpose, the electric camshaft adjustment uses an electric adjusting motor and the hydraulic camshaft adjustment uses a hydraulic rotary piston adjuster, which has vane cells, pivoting vanes, or segmented vanes as a locking unit. This unit fixes the hydraulic adjuster in its base position until a sufficiently high oil pressure has been established for adjusting the camshaft after the restart of the internal-combustion engine.

However, if the internal-combustion engine stalls, a controlled adjustment of the hydraulic camshaft adjuster is impossible, so that the camshaft can be in an undefined position outside of the base position.

For hydraulic camshaft adjusters with a "retarded" base position, when the internal-combustion engine is next started and there is insufficient oil pressure due to the camshaft friction torque, which acts against the camshaft direction of rotation, the camshaft is automatically adjusted into the retarded base position. If the base position is an "advanced" position, for insufficient oil pressure the camshaft must be adjusted against the camshaft friction torque into the advanced position. This is usually performed with the help of a compensating spring, which generates a torque that is equal but opposite the camshaft friction torque.

These methods typical for hydraulic camshaft adjusters for reaching the base position after the internal-combustion engine has stalled are not required for electrically driven camshaft adjusters, because the adjusting motor can adjust the camshaft into the appropriate base position even for a stopped internal-combustion engine or during startup. However, for electric camshaft adjusters, power to the adjusting motor and/or its controller can be lost and therefore the base or emergency running position cannot be reached, which is necessary for at least limited operation and restart.

In DE 41 10 195 A1, an electric adjusting device that adjusts an angle of rotation of the camshaft relative to the crankshaft of an internal-combustion engine is described, with an adjusting gear unit, which is embodied as a triple-shaft gear system, and an input part that is fixed to the crankshaft, an output part that is fixed to the camshaft, as well as an adjusting shaft. Here, the adjusting shaft is connected in a torsion-proof manner to an electric adjusting motor, which has a permanent magnet motor and a stator that is fixed to the housing, wherein for a stationary adjusting shaft, between the input and output part there is a stationary gear ratio $$i_0 = \frac{\text{Output tooth number } Z_{NW}}{\text{Input tooth number } Z_{KW}}$$

whose magnitude determines the type of gear type (positive or negative gear) and the adjusting direction of the camshaft (advanced or retarded base position). This adjusting device strives for a smooth and precise setting of the camshaft position. So that the function of the internal-combustion engine can be maintained at least to some extent if the adjusting-motor system breaks down, there is a limit on the adjusting angle. However, a reference to reaching the base position or an emergency running position in such a case is lacking.

SUMMARY

The objective of the invention is to provide an electric camshaft adjuster, which adjusts the camshaft into its emergency running position or base position in a simple way and without power even if the adjusting motor or its controller breaks down or if the power fails.

Through the structural configuration of the adjusting gear unit, the magnitude of the stationary gear ratio $i_0$ and thus the adjusting device of the camshaft can be defined. The camshaft is adjusted in the direction of the advanced or retarded base position or emergency running position if the adjusting motor or its power supply breaks down through simple braking of the adjusting shaft for a rotating adjusting gear unit. This can be realized during engine operation and during shutdown or startup of the internal-combustion engine. During engine startup and at low engine rotational speeds, the base position of the camshaft is optimal and operation is still possible also at higher rotational speeds, so that at least a repair shop can be reached.

The braking of the adjusting shaft can be realized through a mechanical or eddy-current brake. However, these brakes require electrical current for their activation. In contrast, the short-circuit brake according to the invention operates with short-circuit current, which is generated in the dragged adjusting motor and thus makes the short-circuit brake electrically autonomous. Because no mechanical friction is present, the short-circuit brake operates free from wear and tear.

For the selection of the adjusting gear unit, negative or positive gearing come into play. Negative gearing has a stationary gear ratio $i_0<0$. Positive gearing has a stationary gear ratio $i_0>0$. For a positive stationary gear ratio $i_0$, the input and output shafts have the same direction of rotation. For a negative stationary gear ratio $i_0$, they have opposite directions of rotation relative to a stationary adjusting shaft and the components connected to this shaft.

For a negative gear unit, if the adjusting shaft is fixed and the input shaft rotates clockwise, then the output shaft and thus the camshaft rotates counterclockwise, which corresponds to a retarding adjustment.

For a positive gear unit with a stationary gear ratio $i_0>1$, if the adjusting shaft is fixed and the input shaft rotates clockwise, then the output shaft rotates slower than the input shaft, that means counterclockwise and thus likewise in the direction of a "retarded" base position.

For a positive gear unit with a stationary gear ratio $0<i_0<1$, if the adjusting shaft is fixed and the input shaft rotates clockwise, then the output shaft rotates faster than the input shaft, that means clockwise and thus in the direction of an "advanced" base position. These relationships can be applied to all triple-shaft gear systems in question.

It is advantageous if a double eccentric gear system or a wobble gear system and another double eccentric gear system are provided as the adjusting gearing. Double eccentric gear systems are distinguished by low friction, simple construction, and vibration-free running.

In one advantageous embodiment of the invention, the double eccentric gear system has a cover, which is fixed to the camshaft and which is rigidly connected to axial pins that engage in bore holes of two structurally similar spur pinions with linear contact and the spur pinions, which can be driven by the adjusting motor via a double eccentric shaft, intermesh with a ring gear that is fixed to the crankshaft.

The use of a central standard tension screw with a helical sleeve as the bearing surface for the roller bearing of the double eccentric shaft offers cost advantages, but requires greater axial installation space. The sliding bearing of the structurally similar spur pinions offers cost and installation space advantages for increased friction loss relative to a roller bearing.

It is also advantageous that the tooth number $Z_{NW}$ of each of the two structurally similar spur pinions (equal to output tooth number) is smaller than the tooth number $Z_{KW}$ of the ring gear fixed to the crankshaft (equal to input tooth number), which leads to a stationary gear ratio $0<i_0<1$. For the present positive gear unit and braking of the adjusting shaft, this stationary gear ratio has the effect of camshaft adjustment in the direction towards an "advanced" position, as is typical for exhaust camshafts.

One advantageous improvement of the invention is that another double eccentric gear unit has a drive wheel, which is fixed to the crankshaft and which is connected rigidly to axial pins that engage in bore holes of two structurally similar spur pinions with linear contact, and the structurally similar spur pinions, which can be driven by the adjusting motor via a double eccentric shaft, intermesh with a ring gear fixed to the camshaft.

The bearing of the double eccentric shaft on the cylindrical screw head of a central special tension screw produces axial installation space. Both solutions for the bearing of the double eccentric shaft and the spur pinions are suitable for both double eccentric gear units.

It is also advantageous that the tooth number $Z_{NW}$ of the ring gear fixed to the camshaft (equal to output tooth number) is greater than the tooth number $Z_{KW}$ of one of the structurally similar spur pinion (equal to input tooth number), which leads to a stationary gear ratio $i_0>1$.

The three phases of the adjusting motor have the effect of a low-vibration torque profile of the adjusting motor with simultaneously low installation expense. The possibility of short-circuiting one, two, or all three phases enables a fine control of the short circuit braking torque.

Because short-circuit switches are provided, which are closed when the adjusting motor is not powered and which are opened when the adjusting motor is powered, the fail-safe function of returning the camshaft into its base position or emergency running position is initiated immediately if the adjusting motor and/or its power supply breaks down. This also applies for the case of a stalled internal-combustion engine, whose camshaft position is corrected during the subsequent startup process.

For limiting the temperature build-up of the adjusting motor, clocked short-circuiting is also suitable. Here, the short-circuit switches are opened when a certain short-circuit current has been reached and then automatically closed. This process is preferably controlled and operated by the short-circuit current itself, so that the clocking is functional even if the adjusting motor or the voltage supply of the controller breaks down. The braking current can also be taken from active components, for example, from a storage battery. The automatic closing is realized, for example, through spring force.

For limiting the high short-circuit currents, it is advantageous to arrange a power resistor in the short-circuit lines.

It is also advantageous to provide an electronic current regulator operated with short-circuit current in the short-circuit lines. This solution also functions independent of the power supply of the adjusting motor.

BRIEF DESCRIPTION OF THE DRAWINGS

Additional features of the invention can be taken from the following description and the drawings, in which a preferred embodiment of the invention is shown schematically. In the drawings.

DETAILED DESCRIPTION OF THE PREFERRED EMBODIMENTS

Figure 1:
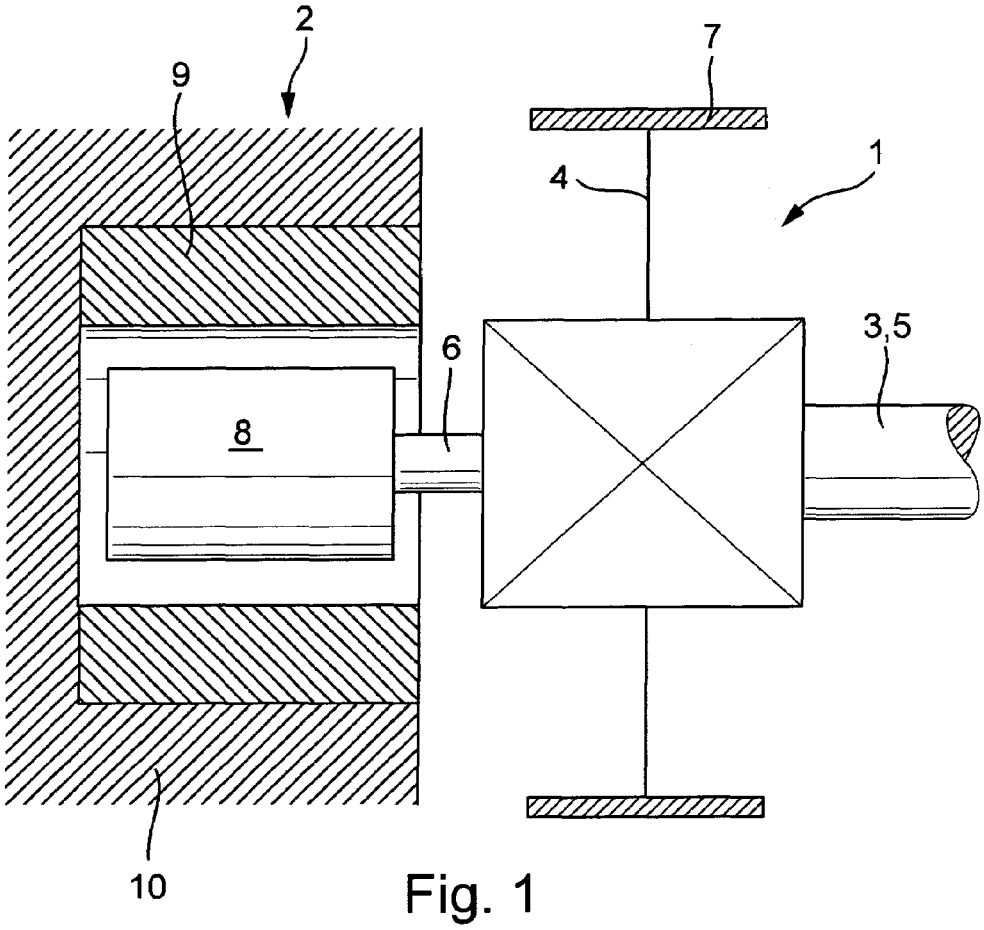
FIG. 1 is a view of a camshaft adjusting device, with adjusting gearing formed as a triple-shaft gear unit and an electric adjusting motor, which has a stator fixed to the housing.

In FIG. 1, a camshaft adjusting device with an adjusting gear unit 1 and an adjusting motor 2 is shown schematically. This device is used for adjusting the position of the angle of rotation between a crankshaft (not shown) and a camshaft 3 of an internal-combustion engine (not shown).

The adjusting gear unit 1 is formed as a triple-shaft gear unit with an input part 4, which is fixed to the crankshaft and which has a drive wheel 7, an output part 5 that is fixed to the camshaft, and an adjusting shaft 6, which is connected in a torsion-proof manner to a permanent magnet rotor 8 of the adjusting motor 2. The adjusting motor 2 has a stator 9, which is arranged fixed in a housing 10.

The camshaft 3 has a base position or emergency running position, which must be reached for reliable startup and limited operation of the internal-combustion engine. This is successful for an intact adjusting motor 2 even after the internal-combustion engine stalls without any difficulty, because the adjusting motor 2 adjusts the camshaft 3 into the base position for a stopped internal-combustion engine or during restart. However, at least a limited motor operation and restart must also be possible if the adjusting motor 2 breaks down in order to be able to reach at least a repair shop.

The adjusting gear unit 1 and its stationary gear ratio $i_0$ are designed so that the camshaft 3 is brought into its base position during startup of the internal-combustion engine through simple braking of the adjusting shaft 6, and the internal-combustion engine thus becomes ready to start.

For a stationary adjusting shaft 6 and input part 4 turning to the right, the following applies for the setting of $i_0$:

For $i_0<0$, a negative gear unit with retard adjustment is provided; for $i_0<1$, a positive gear unit with advance adjustment is provided; and for $i_0>1$, a positive gear unit with retard adjustment is provided.

Figure 2:
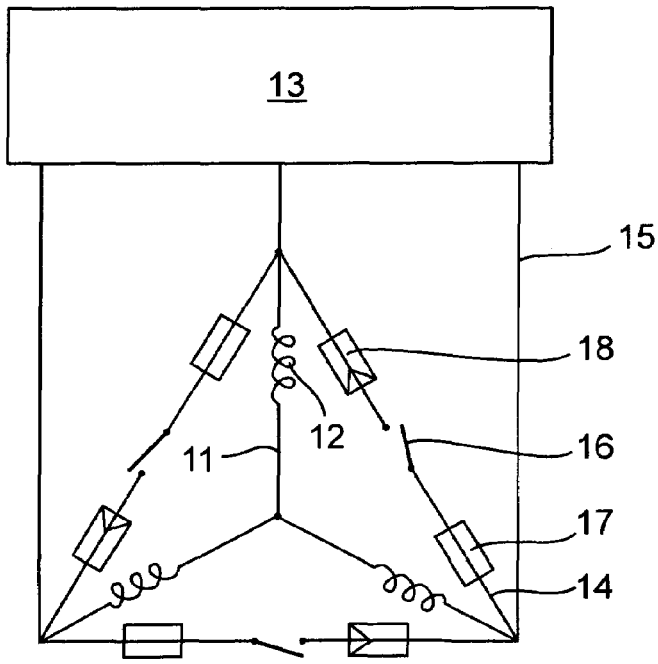
FIG. 2 is a circuit schematic of a three-phase DC adjusting motor with short-circuit lines and short-circuit switches.

In FIG. 2, a circuit diagram for the stator 9 of the adjusting motor 2 is shown. The adjusting motor 2 is formed as a brushless DC motor with three phases 11 connected in a star, which have stator windings 12 and are powered by a controller 13 via phase-corrected control lines 15.

The three phases 11 are connected in a triangle by short-circuit lines 14. In the short-circuit lines 14, short-circuit switches 16 are provided, which are closed when the adjusting motor 2 is not powered and which are opened when the adjusting motor 2 is powered. Closing the short-circuit switches 16 makes a short-circuit current flow, which is used for short-circuit braking of the adjusting motor 2 operated as a generator. The closing of the short-circuit switches 16 can be realized individually or as a whole, which allows the braking force to be controlled.

Because a short-circuit current that is too high endangers the adjusting motor 2, a current limiter is necessary. This can be realized through current-dependent opening of the short-circuit switches 16, which automatically close, for example, through spring force, when the current falls below a limiting value.

The short-circuit current can also be limited by power resistors 17 in the short-circuit lines 14. An electric current regulator 18, which is arranged in the short-circuit lines 14 and which is powered by the short-circuit current, is used for the same purpose.

Figure 3:
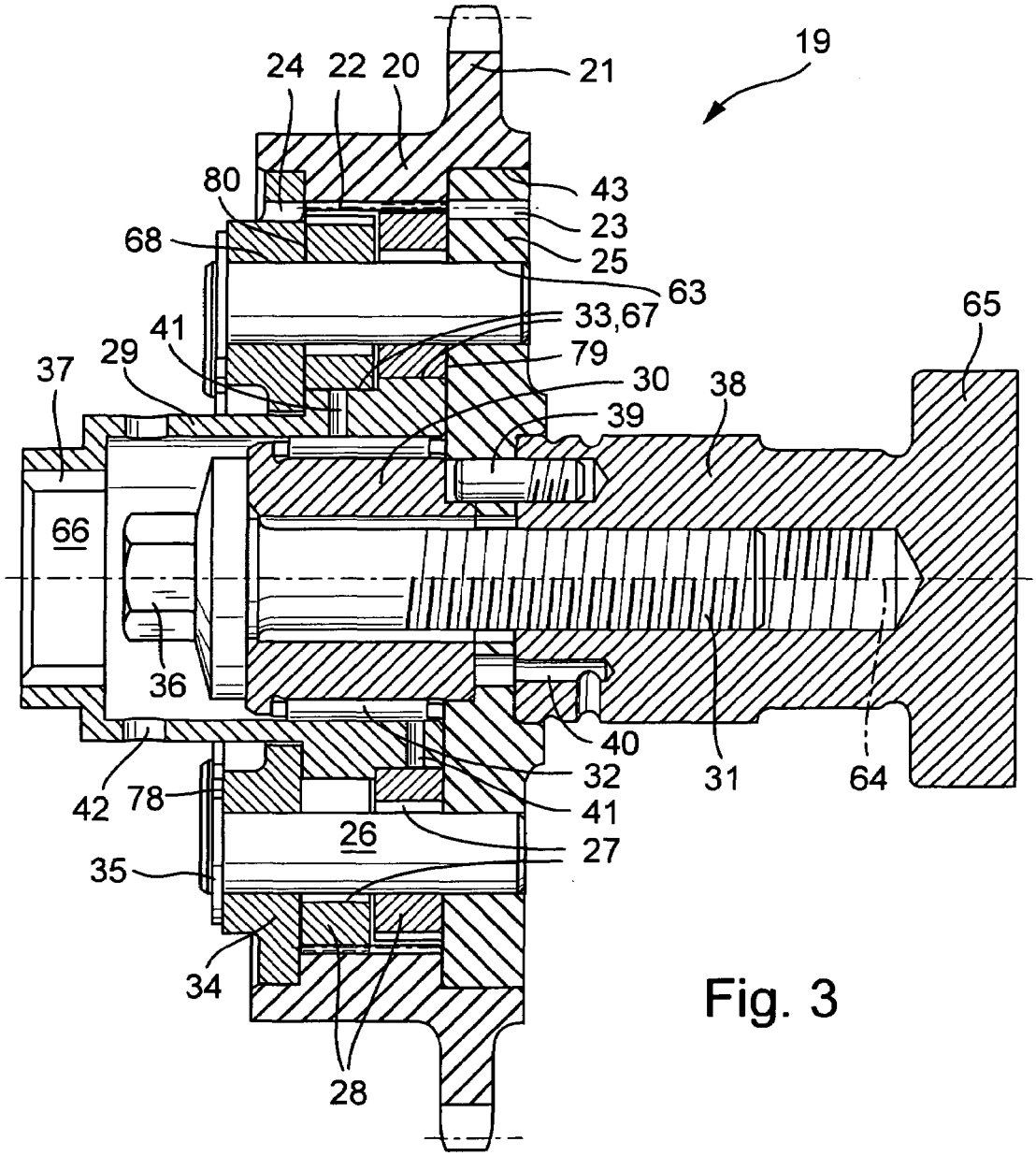
FIG. 3 is a cross-sectional view of a double eccentric gear unit with a ring gear fixed to the crankshaft.
Figure 4:
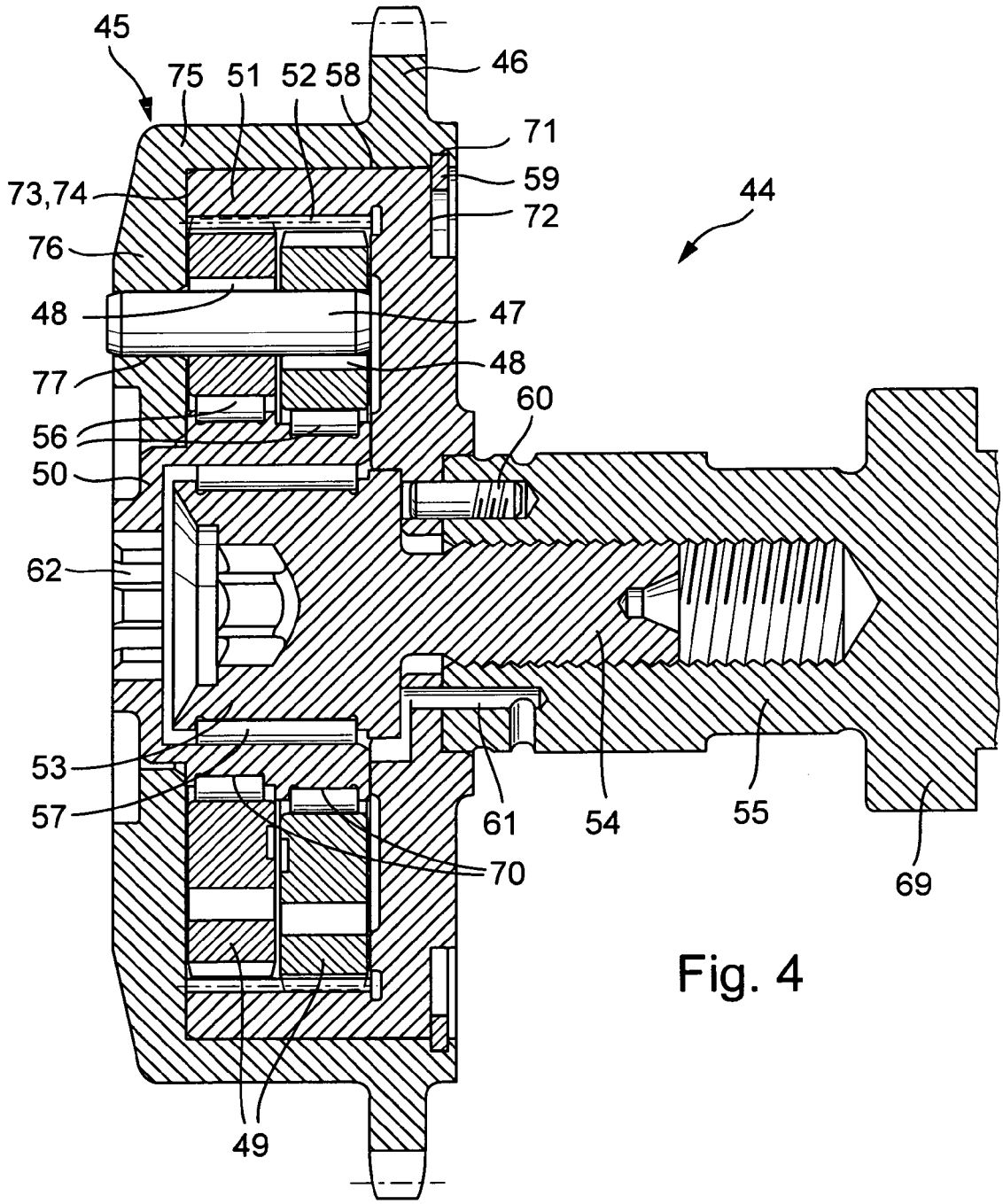
FIG. 4 is a cross-sectional view of a double eccentric gear unit with a ring gear fixed to the camshaft.

In FIGS. 3 and 4, adjusting gear units are shown, which are formed as triple-shaft gear units, with similar components that are arranged differently, however.

FIG. 3 shows a double eccentric gear unit 19 with a chain wheel 21 fixed to the crankshaft, a cover 25 fixed to the camshaft, and an adjusting shaft, which is formed as a double eccentric shaft 29. This is connected to a not-shown adjusting motor via a suitable detachable keyed shaft coupling 37. The detachable couplings can also be, among other things, splined, polygon, toothed, two-edged, square, and hexagonal shaft couplings.

The cover 25 that is fixed to the camshaft is attached with the help of a central standard tension screw 31 via an adapter sleeve 30 with a camshaft pin 38 of a camshaft 65. An opening 66 of the shaft coupling 37 enables the access of a drive tool to a head 36 of the central standard tension screw 31.

The position of the angle of rotation between the camshaft 65 and the cover 25 fixed to the camshaft is set by a positioning pin 39, which is arranged with a force fit in aligned bore holes of the cover 25 and the camshaft pin 38.

The adapter sleeve 30 is used simultaneously as a bearing surface for a needle bushing 32 of the double eccentric shaft 29. This has two equal, but offset by 180° and thus completely balanced eccentrics 67, which drive two structurally similar spur pinions 28 via sliding bearing 33. The spur pinions 28 intermesh with internal teeth 22 of a ring gear 20, which is fixed to the crankshaft and which is formed integrally with the chain wheel 21.

The cover 25 that is fixed to the camshaft has axial bore holes 63, in which pins 26 are pressed. These penetrate through axial bore holes 27 of the structurally similar spur pinions 28 and project through axial bore holes 68 of a cover plate 34. The axial bore holes 63, 68 are aligned and lie at a uniform distance on a circle about the rotational axis 64 of the camshaft adjuster. The axial bore holes 27 have a diameter that is greater by twice the eccentricity of the eccentric 67 than the pins 26, which have linear contact on the inner periphery of the axial bore holes 27.

The cover plate 34 is used for closing the double eccentric gear unit 19 and for axial positioning of the double eccentric shaft 29, the spur pinions 28, and the ring gear 20. It is fixed in the axial direction by securing rings 35. These sit in grooves 78, which are arranged on the ends of the pins 26 projecting from the axial bore holes 68 of the cover plate 34. The position of the grooves 78 determines the distance of the inner surfaces 79, 80 of the cover 25 and the cover plate 34. Here, the axial play necessary for the relative motion relative to the corresponding contact surfaces of the double eccentric shaft 29, the spur pinions 28, and the ring gear 20 is taken into account.

The ring gear 20 is supported on the cover 25 by a sliding bearing 43, which receives, among other things, the forces of the chain wheel 21. This is formed integrally with the ring gear 20 and is in torsion-proof connection to the crankshaft of the internal-combustion engine via a chain, by which it is driven at half the crankshaft rotational speed. The driving torque of the chain wheel 21 is transferred via the spur pinions 28 and the pins 26 to the cover 25 and the camshaft 65. The number of pins 26 depends on the magnitude of the driving torque.

The double eccentric gear unit 19 is lubricated by lubricating motor oil. This is led from an inflow line 40 of the camshaft pin 38 into the needle bushing 32 and from there through centrifugal force via radial lubricating oil bore holes 41 in the sliding bearing 33, in the axial bore holes 27, to the internal teeth 22, to the sliding bearing 43 and via closing bore holes 23, 24 into the engine chamber. Oil is removed from the double eccentric shaft 29 through radial discharge bore holes 42. The double eccentric gear unit 19 is a positive gear unit, that means the direction of rotation of the chain wheel 21 and the camshaft 64 are the same. Because each of the spur pinions 28 has a smaller tooth number $Z_{NW}$ than the tooth number $Z_{KW}$ of the ring gear 20 that is fixed to the crankshaft, this produces a stationary gear ratio:

$$i_0 = \frac{Z_{NW}}{Z_{KW}} 0 < i_1 < 1.$$

In the present case, if the rotational speed of the double eccentric shaft 29, for example, through short-circuit braking of the adjusting motor, is smaller than that of the chain wheel 21, then its rotational speed is lower than that of the camshaft 65, wherein this is adjusted in the direction towards an "advanced" position.

FIG. 4 shows another double eccentric gear unit 44, with a chain wheel 46 that is fixed to the crankshaft, a ring gear 51 that is fixed to the camshaft, and an adjusting shaft formed as a double eccentric shaft 50. This is connected to the adjusting motor (not shown) via a detachable splined shaft coupling 62. The double eccentric gear unit 44 is tensioned by a special central tension screw 54 with a camshaft pin 55 of a camshaft 69. Here, the position of the angle of rotation between the camshaft 69 and the double eccentric gear unit 44 is also set by a positioning pin 60, which sits in a force fit in aligned bore holes of the ring gear 51 and the camshaft pin 55. The central special tension screw 54 can be tightened through the splined shaft coupling 62.

A cylindrical head 53 of the special tension screw 54 is used simultaneously as the support surface for the needle bushing 57 of the double eccentric shaft 50, which is therefore built extremely short. In turn, it has two equal eccentrics 70, which are offset by 180° and which drive two structurally similar spur pinions 49 via the roller bearings 56. The roller bearings 56 can also be replaced by sliding bearings, which produce savings in terms of cost and installation space but exhibit higher friction.

The spur pinions 49 intermesh with internal teeth 52 of the ring gear 51 that is fixed to the camshaft. On its periphery, there is a drive wheel 45 that is fixed to the crankshaft with a peripheral part 75 that is formed integrally with the chain wheel 46 and a side part 76. The latter is used, among other things, for closing the side of the double eccentric gear unit 44. The peripheral part 75 is supported on the periphery of the ring gear 51 in a sliding bearing 58. The side part 76 has axial bore holes 77, in which axial pins 47 are pressed, which engage in bore holes 48 of the spur pinions 49 as in FIG. 3 and transfer the driving torque of the drive wheel 45 via the spur pinions 49 to the ring gear 51 and to the camshaft 69. The drive wheel 45 that is fixed to the crankshaft and with it the spur pinions 49 and the double eccentric shaft 50 are fixed in the axial direction by a retaining ring 59. This sits in a radial groove 71 of the drive wheel 45 that is fixed to the crankshaft and contacts with one edge an end 72 of the ring gear 51 near the camshaft. The end 73 of the ring gear 45 far from the camshaft contacts the axial inner side 74 of the drive wheel 45 with play. This play enables the relative motion of the ring gear 51, drive wheel 45, spur pinions 49, and double eccentric shaft 50.

The double eccentric gear unit 44 is lubricated as in the double eccentric gear unit 19 through an inflow bore hole 61 to the needle bushing 57 and from there through centrifugal force to the other components.

The double eccentric gear unit 44 likewise concerns a positive gear unit. Because the tooth number $Z_{NW}$ of the ring gear 52 that is fixed to the camshaft is greater than the tooth number $Z_{KW}$ of each of the structurally similar spur pinions 49, this produces a stationary gear ratio:

$$i_0 = \frac{Z_{NW}}{Z_{KW}} > 1$$

In this case, if the rotational speed of the double eccentric shaft, for example, through short-circuit braking of the adjusting motor, is smaller than that of the chain wheel 46, then the camshaft 69 turns slower than this and adjusts towards a "retarded" position.

The double eccentric gear unit 19 is used as the adjusting gear unit of an exhaust camshaft with "advanced" base position. The other double eccentric gear unit 44 is used as an adjusting gear unit of an inlet camshaft with "retarded" base position.

| List of reference symbols | |
|---|---|
| 1 | Adjusting gear unit |
| 2 | Adjusting motor |
| 3 | Camshaft |
| 4 | Input part |
| 5 | Output part |
| 6 | Adjusting shaft |
| 7 | Drive wheel |
| 8 | Permanent magnet rotor |
| 9 | Stator |
| 10 | Housing |
| 11 | Phase |
| 12 | Stator winding |
| 13 | Controller |
| 14 | Short-circuit line |
| 15 | Control line |
| 16 | Short-circuit switch |

-continued

| List of reference symbols | |
|---|---|
| 17 | Power resistor |
| 18 | Electronic current regulator |
| 19 | Double eccentric gear unit |
| 20 | Ring gear fixed to crankshaft |
| 21 | Chain wheel |
| 22 | Internal teeth |
| 23 | Discharge bore hole |
| 24 | Discharge bore hole |
| 25 | Cover fixed to the camshaft |
| 26 | Pin |
| 27 | Axial bore hole |
| 28 | Spur pinion |
| 29 | Double eccentric shaft |
| 30 | Adapter sleeve |
| 31 | Standard tension screw |
| 32 | Needle bushing |
| 33 | Sliding bearing |
| 34 | Seal cover |
| 35 | Securing ring |
| 36 | Standard head |
| 37 | Keyed shaft coupling |
| 38 | Camshaft pin |
| 39 | Positioning pin |
| 40 | Inflow line |
| 41 | Lubricating oil bore hole |
| 42 | Discharge bore hole |
| 43 | Slide bearing |
| 44 | Other double eccentric gear unit |
| 45 | Drive wheel fixed to the crankshaft |
| 46 | Chain wheel |
| 47 | Axial pin |
| 48 | Bore hole |
| 49 | Spur pinion |
| 50 | Double eccentric shaft |
| 51 | Ring gear fixed to camshaft |
| 52 | Internal teeth |
| 53 | Cylindrical head |
| 54 | Special tension screw |
| 55 | Camshaft pin |
| 56 | Roller bearing |
| 57 | Needle bushing |
| 58 | Slide bearing |
| 59 | Securing ring |
| 60 | Positioning pin |
| 61 | Inflow bore hole |
| 62 | Splined shaft coupling |
| 63 | Axial bore hole |
| 64 | Rotational axis |
| 65 | Camshaft |
| 66 | Opening |
| 67 | Eccentric |
| 68 | Axial bore hole |
| 69 | Camshaft |
| 70 | Eccentric |
| 71 | Radial groove |
| 72 | End near camshaft |
| 73 | End far from camshaft |
| 74 | Axial inner side |
| 75 | Peripheral part |
| 76 | Side part |
| 77 | Axial bore hole |
| 78 | Groove |
| 79 | Inner side |
| 80 | Inner side |

What is claimed is:

1. An electrical adjusting device for changing an angle of rotation of a camshaft (3, 65, 69) relative to a crankshaft of an internal-combustion engine, comprising an adjusting gear unit (1), which is formed as a triple-shaft gear unit, comprising an input part (4) that is fixed to the crankshaft; an output part (5) that is fixed to the camshaft; and an adjusting shaft (6); the electrical adjusting device further comprising an electric adjusting motor (2) having a permanent magnet rotor (8) and a stator (9) fixed to a housing, the adjusting shaft being connected in a torsion-proof manner to the electric adjusting motor (2); and a stationary gear ratio $$i_0 = \frac{\text{Output tooth number } Z_{NW}}{\text{Input tooth number } Z_{KW}},$$

between the input part (4) and the output part (5) for the adjusting shaft (6), whose magnitude determines a type of the adjusting gear unit (1) as a positive or negative gear unit and determines a direction of adjustment of the camshaft (3, 65, 69) into an advanced or retarded base position, and through which an advanced and a retarded base position of the camshaft (3, 65, 69) can be reached exclusively through braking of the adjusting shaft (6) when the adjusting gear unit (1) is rotating, and the braking of the adjusting shaft (6) is carried out through short-circuit braking of the adjusting motor (2).

2. An electrical adjusting device according to claim 1, wherein a positive gear unit for a camshaft adjustment in a direction towards an "advanced" position is provided with the stationary gear ratio $0<i_0<1$, and a positive gear unit for a camshaft adjustment in a direction towards a "retarded" position is provided with a stationary gear ratio $i_0>1$.

3. An electrical adjusting device according to claim 2, wherein a double eccentric gear unit (19) or a wobble gear unit and another double eccentric gear unit (44) are provided as the adjusting gear unit (1).

4. An electrical adjusting device according to claim 3, wherein the double eccentric gear unit (19) has a cover (25), which is fixed to the camshaft and which is connected rigidly to axial pins (26), which engage in bore holes (27) of two spur pinions (28) with linear contact, and the spur pinions (28), which can be driven by the adjusting motor (2) via a double eccentric shaft (29), intermesh with a ring gear (20) that is fixed to the crankshaft.

5. An electrical adjusting device according to claim 4, wherein the double eccentric shaft (29) is supported by rollers on a helical sleeve (30) of a central standard tension screw (31) with a needle bushing (32) and the spur pinions (28) are supported on the double eccentric shaft (29) by slide bearings (33).

6. An electrical adjusting device according to claim 5, wherein an output tooth number $Z_{NW}$ of each of the two spur pinions (28) is smaller than an input tooth number $Z_{KW}$ of the ring gear (20) that is fixed to the crankshaft, which leads to a stationary gear ratio $0<i_0<1$.

7. An electrical adjusting device according to claim 3, wherein the other double eccentric gear unit (44) has a drive wheel (45), which is fixed to the crankshaft and which is connected rigidly to axial pins (47), which engage in bore holes (48) of two spur pinions (49) with linear contact, and the spur pinions (49), which can be driven by the adjusting motor (2) via a double eccentric shaft (50), intermesh with a ring gear (51) that is fixed to the camshaft.

8. An electrical adjusting device according to claim 7, wherein the double eccentric shaft (50) is supported on a cylindrical head (53) of a central special tension screw (54) and the spur pinions (49) are supported on the double eccentric shaft (50) by roller bearings (56).

9. An electrical adjusting device according to claim 8, wherein an output tooth number $Z_{NW}$ of the ring gear (51) that is fixed to the camshaft is greater than an input tooth number $Z_{KW}$ of one of the structurally similar spur pinions (49), which leads to a stationary gear ratio $i_0>1$.

10. An electrical adjusting device according to claim 1, wherein the stator (9) of the adjusting motor (2) has three phases (11), which can be short-circuited individually and as a whole for short-circuit braking of the adjusting motor (2).

11. An electrical adjusting device according to claim 10, wherein short-circuit switches (16) are provided, which are closed when the adjusting motor (2) is not powered and which are opened when the adjusting motor (2) is powered.

12. An electrical adjusting device according to claim 11, wherein means for limiting the short-circuit current are provided.

13. An electrical adjusting device according to claim 12, wherein the short-circuit switches (16) open when a limiting value of a short-circuit current is exceeded, and automatically close when the short-circuit current falls below the limiting value.

14. An electrical adjusting device according to claim 12, wherein a power resistor (17) is arranged in the short-circuit lines (14).

15. An electrical adjusting device according to claim 12, wherein a current regulator 18 operating with short-circuit current is provided in the short-circuit lines 14.

* * * * *